US008374528B2

(12) United States Patent
Kubo et al.

(10) Patent No.: US 8,374,528 B2
(45) Date of Patent: Feb. 12, 2013

(54) DEVELOPING DEVICE, PROCESS CARTRIDGE, AND IMAGE FORMING APPARATUS THAT HOUSE A DEVELOPING AGENT FOR FORMING AN IMAGE

(75) Inventors: Tatsuya Kubo, Tokyo (JP); Yoshitaka Fujinuma, Tokyo (JP); Susumu Tateyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/280,027

(22) Filed: Oct. 24, 2011

(65) Prior Publication Data

US 2012/0039627 A1 Feb. 16, 2012

Related U.S. Application Data

(63) Continuation of application No. 12/196,604, filed on Aug. 22, 2008, now Pat. No. 8,045,900.

(30) Foreign Application Priority Data

Aug. 30, 2007 (JP) ..... 2007-224438

(51) Int. Cl.
*G03G 15/08* (2006.01)

(52) U.S. Cl. ..... 399/260

(58) Field of Classification Search ..... 399/260, 399/262, 263, 258, 259, 264
See application file for complete search history.

(56) References Cited

U.S. PATENT DOCUMENTS

| | | | |
|---|---|---|---|
| 6,047,154 | A | 4/2000 | Kawaguchi |
| 6,978,106 | B2 | 12/2005 | Masuda |
| 7,792,465 | B2 | 9/2010 | Kubo et al. |
| 7,826,775 | B2 | 11/2010 | Nakayama et al. |
| 7,904,001 | B2 | 3/2011 | Tateyama et al. |
| 8,014,706 | B2 | 9/2011 | Nakayama et al. |
| 8,027,623 | B2 | 9/2011 | Nodera et al. |
| 8,041,269 | B2 | 10/2011 | Kubo et al. |
| 8,045,893 | B2 | 10/2011 | Nakayama et al. |
| 2003/0086727 | A1 | 5/2003 | Iwata |
| 2004/0265008 | A1 | 12/2004 | Tomono et al. |
| 2005/0123312 | A1 | 6/2005 | Mabuchi |

(Continued)

FOREIGN PATENT DOCUMENTS

| | | | |
|---|---|---|---|
| JP | 11-219013 | | 8/1999 |
| JP | 11219013 | A * | 8/1999 |

(Continued)

OTHER PUBLICATIONS

Japanese Office Action issued Feb. 3, 2012, in Patent Application No. 2007-224438.

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

A developing device, process cartridge, and image forming apparatus, include at least one developing roller. A plurality of transport members with screw and shaft portions, transport developing agent housed within the device in a longitudinal direction, and form a circulation path. A discharge aperture, formed in a transport path wall of one transport member, discharges developing agent to the outside when a surface of the developing agent transported by one of the plurality of transport members exceeds a predetermined height. The one transport member is adjacent to the developing roller that supplies the developing agent and includes, in a part in the longitudinal direction, an area on which the screw portion is not formed. The discharge aperture is disposed opposite to the area on which the screw portion is not formed, and the length of the discharge aperture is formed smaller than that of the area in the longitudinal direction.

19 Claims, 9 Drawing Sheets

U.S. PATENT DOCUMENTS

* cited by examiner

| | | | | |
|---|---|---|---|---|
| 2007/0025773 | A1 * | 2/2007 | Tateyama et al. | 399/254 |
| 2008/0008502 | A1 * | 1/2008 | Hatakeyama et al. | 399/254 |
| 2008/0152394 | A1 | 6/2008 | Hatakeyama et al. | |
| 2009/0067878 | A1 | 3/2009 | Tateyama et al. | |

FOREIGN PATENT DOCUMENTS

| | | | |
|---|---|---|---|
| JP | 2000-112238 | | 4/2000 |
| JP | 2000112238 | A * | 4/2000 |
| JP | 2001-83802 | | 3/2001 |
| JP | 2003-263012 | | 9/2003 |

DEVELOPING DEVICE, PROCESS CARTRIDGE, AND IMAGE FORMING APPARATUS THAT HOUSE A DEVELOPING AGENT FOR FORMING AN IMAGE

CROSS REFERENCE TO RELATED APPLICATIONS

This application is a continuation of U.S. Ser. No. 12/196,604, filed Aug. 22, 2008 now U.S. Pat. No. 8,045,900, the entire content of which is incorporated herein by reference, and is based upon and claims the benefit of priority from prior JP App. No. 2007-224438 filed Aug. 30, 2007.

BACKGROUND OF THE INVENTION

1. Field of the Invention

The present invention relates to an image forming apparatus using the electrophotographic method for, such as a photocopier, printer, facsimile machine, or a multi-function machine, and the developing device and process cartridge installed therein. More particularly the present invention relates to a premixed developing system developing device in which new carrier is supplied to the developing device as appropriate, a process cartridge, and an image forming apparatus.

2. Description of the Related Art

Conventionally, in image forming apparatus such as multipurpose machines, printers, and the like, technology (referred to as the premixed developing system) for supplying new carrier to a developing device that contains two part developing agent made from toner and carrier (including the case where additives or the like are added) is disclosed in, for example, Japanese Patent Application Laid-open No. 2001-183893 and Japanese Patent Application Laid-open No. 2000-112238, and elsewhere.

In a developing device using two component developing agent, as toner is consumed within the developing device, toner is replenished as appropriate into the developing device through a toner replenishing aperture provided in a part of the developing device. The supplied toner is agitated and mixed with the developing agent within the developing device by a transport member (agitation member) such as a screw or the like. A part of the agitated and mixed developing agent is supplied to a developing roller. The developing agent on the developing roller is controlled to an appropriate amount by a doctor blade. Then at the position in opposition to the photosensitive drum, the toner in the two part developing agent adheres to the latent image on the photosensitive drum.

In this way, in the normal developing process the carrier in the two part developing agent housed in the developing device is not consumed but remains within the developing device, so the carrier becomes degraded with the passage of time. In more detail, as a result of agitation and mixing of the carrier within the developing device over a long period of time, a "film depletion phenomenon" occurs, in which the coating layer of the carrier becomes worn or peels off, which reduces the carrier charging capacity, or a "spent phenomenon" occurs in which components of toner or additives adhere to the surface of the carrier, which reduces the carrier charging capacity.

The premixed developing system is a system to prevent the reduction in image quality of the images output as a result of this degradation of the carrier with time. In other words, by supplying new carrier (or new two part developing agent) as appropriate to the developing device, and discharging a part of the two part developing agent housed within the developing device outside the developing device as appropriate, the degraded carrier within the developing device is reduced, and it is possible to maintain the quantity of carrier housed within the developing device and its charging capacity.

Compared with image forming apparatus for which it is necessary to change the developing device or carrier with new product every time degradation of the carrier with time occurs, the quality of the images output from an image forming apparatus that uses the premixed developing system as described above is more stable with time.

In Japanese Patent Application Laid-open No. 2001-183893 and Japanese Patent Application Laid-open No. 2000-112238, image forming apparatus using the premixed developing system are disclosed in which an overflow system is used as discharge means for discharging the developing agent outside the developing device. In detail, a discharge aperture (hole) is provided in the wall of the developing device, and when the surface of the developing agent transported to this position exceeds a predetermined level, the developing agent (the developing agent that has become excess as a result of replenishing with carrier) is discharged to the outside from the discharge aperture.

Also, in Japanese Patent Application Laid-open No. 2000-112238, in order to reduce the quantity of developing agent discharged from the discharge aperture (developing agent discharge aperture), technology is disclosed in which the screw of the transport member (agitation and transport member) in opposition to the discharge aperture is removed (or reduced in diameter).

In the premixed developing system developing device according to Japanese Patent Application Laid-open No. 2001-183893, in addition to the developing agent that was intended to be discharged, the necessary developing agent was also discharged from the discharge aperture. As a result, the developing agent within the developing device was excessively discharged, and the developing agent became insufficient. Specifically, although only developing agent whose surface height exceeded a predetermined height was intended to be discharged, developing agent that was thrown up by the transport member was also discharged from the discharge aperture.

When the amount of developing agent within the developing device becomes insufficient in this way, the state of degradation of the developing agent becomes unstable, the amount of charge on the toner is reduced, the image density of the images output is reduced, and other problems occur.

In order to solve this problem, in Japanese Patent Application Laid-open No. 2000-112238, the screw is eliminated (or reduced in diameter) from the transport member opposite the discharge aperture. However, as a result of the researches by the inventors of the present application, it was found that by eliminating the screw from the transport member opposite the discharge aperture alone, it was not possible to sufficiently reduce the discharge from the discharge aperture of the developing agent thrown up by the transport member.

SUMMARY OF THE INVENTION

The present invention was devised to solve the above problem, so it is an object of the present invention to provide a premixed developing system developing device, process cartridge, and image forming apparatus in which developing agent thrown up by the transport member is not discharged from the discharge aperture, there is no variation in the quantity of developing agent discharged to the outside, and the image quality of the images output is stable.

In an aspect of the present invention, a developing device houses a developing agent comprising carrier and toner, and develops a latent image formed on an image carrier. The developing device comprise a plurality of transport members which have a screw portion formed on a shaft portion, and which transport the developing agent housed within the device in a longitudinal direction, and form a circulation path; a supply device for supplying new carrier to the device; and a discharge aperture, formed in a wall of a transport path of one of the transport members, for discharging the developing agent to the outside when a surface of the developing agent transported by one of the plurality of transport members exceeds a predetermined height. The one of the transport members comprises, in a part in the longitudinal direction, an area on which the screw portion is not formed. The discharge aperture is disposed opposite to the area on which the screw portion is not formed on the one of the transport members, and the length of the discharge aperture is formed smaller than that of the area in the longitudinal direction.

In another aspect of the present invention, a process cartridge is detachably installed in a main body of an image forming apparatus. A developing device and an image carrier are integrated. The developing device houses a developing agent comprising carrier and toner, and develops a latent image formed on an image carrier. The developing device comprises a plurality of transport members which have a screw portion formed on a shaft portion, and which transport the developing agent housed within the device in a longitudinal direction, and form a circulation path; a supply device for supplying new carrier to the device; and a discharge aperture, formed in a wall of a transport path of one of the transport members, for discharging the developing agent to the outside when a surface of the developing agent transported by one of the plurality of transport members exceeds a predetermined height. The one of the transport members comprises, in one portion in the longitudinal direction, an area on which the screw portion is not formed. The discharge aperture is disposed opposite to the area on which the screw portion is not formed on the one of the transport members, and the length of the discharge aperture is formed smaller than that of the area in the longitudinal direction.

In another aspect of the present invention, an image forming apparatus has a developing device and an image carrier. The developing device is houses a developing agent comprising carrier and toner, and that develops a latent image formed on an image carrier. The developing device comprises a plurality of transport members which have a screw portion formed on a shaft portion, and which transport the developing agent housed within the device in a longitudinal direction, and form a circulation path; a supply device for supplying new carrier to the device; and a discharge aperture, formed in a wall of a transport path of one of the transport members, for discharging the developing agent to the outside when a surface of the developing agent transported by one of the plurality of transport members exceeds a predetermined height. The one of the transport members comprises, in one portion in the longitudinal direction, an area on which the screw portion is not formed. The discharge aperture is disposed opposite to the area on which the screw portion is not formed on the one of the transport members, and the length of the discharge aperture is formed smaller than that of the area in the longitudinal direction.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENT(S)

Figure 1:
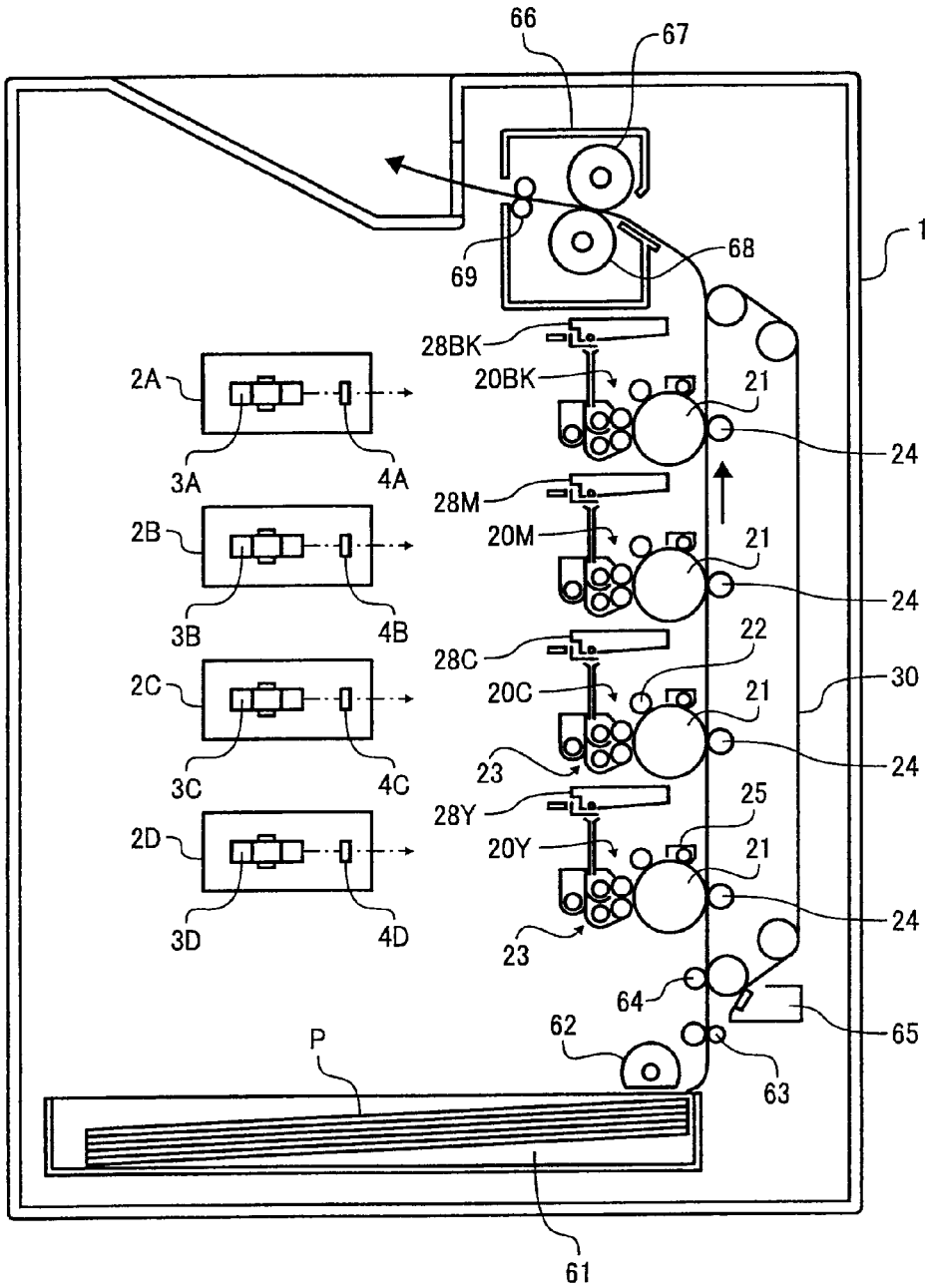
FIG. 1 is a diagram showing the overall constitution of an image forming apparatus according to an embodiment of the present invention.

First, as a result of repeated research by the three inventors to solve the above problem of the Prior Art, the following facts became clear. Namely, by placing the area of the transport member from which the screw was removed in opposition to the discharge aperture, and making the length in the length direction of the discharge aperture smaller than that of the area of the transport member from which the screw was removed, it is possible to sufficiently reduce the problem of developing agent thrown up by the transport member being discharged from the discharge aperture.

In this application, "process cartridge" is defined as a unit in which at least one of a charging unit that charges an image carrier, a developing unit (developing device) that develops latent images formed on the image carrier, and a cleaning unit that cleans the image carrier is integrated with the image carrier, and is demountably installed within the image forming apparatus.

The following is a detailed explanation of an embodiment of the present invention, with reference to the drawings. In the drawings, the same or the equivalent part is given the same reference symbol, so duplication of explanation is simplified or omitted as appropriate.

First, the overall constitution and operation of the image forming apparatus according to the present embodiment as shown in FIG. 1 is explained.

Writing units 2A to 2D are devices for writing electrostatic latent images based on image information on a photosensitive drum 21 (image carrier) that has been charged. The writing units 2A to 2D are optical scanning devices using polygon mirrors 3A to 3D, optical elements 4A to 4D, and the like. The writing units may use an LED array instead of the optical scanning device.

A sheet supply unit 61 houses recording sheets, OHPs, or other transfer material P, and when images are being formed the transfer material P is supplied to a transfer belt 30.

The transfer belt 30 is an endless belt that electrostatically attracts the transfer material P to its surface and transports the transfer material P so that a toner image formed on the photosensitive drum 21 is transferred onto the transfer material P.

An adhesion roller 64 and a belt cleaner 65 are provided on the outer surface of the transfer belt 30.

A transfer roller 24, which is disposed in opposition to the photosensitive drum 21 with the transfer belt 30 therebetween, has a metal core and an electrically conducting elastic layer that covers the metal core. The electrically conducting elastic layer of the transfer roller 24 is an elastic material such as polyurethane rubber, ethylene propylene diene polyethylene (EPDM), or the like, in which a material to give electrical conductivity such as carbon black, zinc oxide, tin oxide, or the like, is dispersed so that the value of the electrical conductivity (volume resistivity) is adjusted to an intermediate resistance.

A fixing unit 66 includes a heating roller 68 and a pressure roller 67, and fixes the toner image on the transfer material P onto the transfer material P using pressure and heat.

Four process cartridges 20Y, 20C, 20M, 20BK disposed in the vertical direction along the transfer belt 30 are for forming toner images in yellow, cyan, magenta, and black respectively.

Each process cartridge 20Y, 20C, 20M, 20BK includes a developing agent cartridge 28Y, 28C, 28M, 28BK which is supply means for supplying the developing device 23 with carrier (magnetic carrier) and toner (toner powder) in each color (yellow, cyan, magenta, and black) respectively.

The process cartridges 20Y, 20C, 20M, 20BK and the developing agent cartridges 28Y, 28C, 28M, 28BK can be inserted into and removed from the main body 1 of the apparatus by releasing the transfer belt 30 around the rotation support shaft.

The image forming apparatus according to the present embodiment is a multi-purpose system image forming apparatus that functions as a photocopier and as a printer. When functioning as a photocopier, the image information read from the scanner is subjected to various image processing operations such as A/D conversion, MTF correction, processing of tones, and so on, and converted into data to be written. When functioning as a printer, image processing is carried out on the page description language and image information in bitmap or other formats to convert it into data to be written.

When forming images, exposure light corresponding to the black, magenta, cyan, and yellow image information is emitted from the writing units 2A to 2D to the process cartridges 20BK, 20M, 20C, and 20Y respectively. In other words, exposure light (laser light) emitted from each of the light sources passes through the polygon mirrors 3A to 3D, the optical elements 4A to 4D, and so on, and illuminates each photosensitive drum 21. As a result, toner images are formed on the photosensitive drums 21 (image carriers) of each process cartridge 20BK, 20M, 20C, and 20Y. Then these toner images are transferred to the transfer material P.

The transfer material P supplied from the sheet supply unit 61 is transported to the position of the transfer belt 30, after adjustment of timing at a registration roller 63. A voltage is applied to the adhesion roller 64, which is disposed at the position where the transfer material P is fed to the transfer belt 30, which causes the transfer material P that is fed to be attracted to the transfer belt 30. As the transfer belt 30 moves in the direction of the arrow, the transfer material P is moved, passes the positions of each process cartridge 20Y, 20C, 20M, 20BK successively, where the toner images in each color are transferred and superimposed.

The transfer material P onto which the color toner images have been transferred is separated from the transfer belt 30 and arrives at the fixing unit 66. The toner image on the transfer material P is heated while sandwiched between the heating roller 68 and pressure roller 67, and fixed onto the transfer material P. After the transfer material P is separated, the surface of the transfer belt 30 arrives at the position of the belt cleaner 65, where toner adhering to the surface of the transfer belt 30 and other dirt is cleaned off.

Next, the process cartridges and developing agent cartridges in the image forming apparatus is explained in detail.

Each process cartridge 20Y, 20C, 20M, 20BK has virtually the same structure, and each developing agent cartridge 28Y, 28C, 28M, 28BK has virtually the same structure. Therefore, in FIG. 2 the alphabetic letters (Y, C, M, BK) of the reference numerals of the process cartridges and the developing agent cartridges are omitted from the drawing. Also, the alphabetic letters (A to D) of the reference numerals of the writing units are omitted from the drawing.

Figure 2:
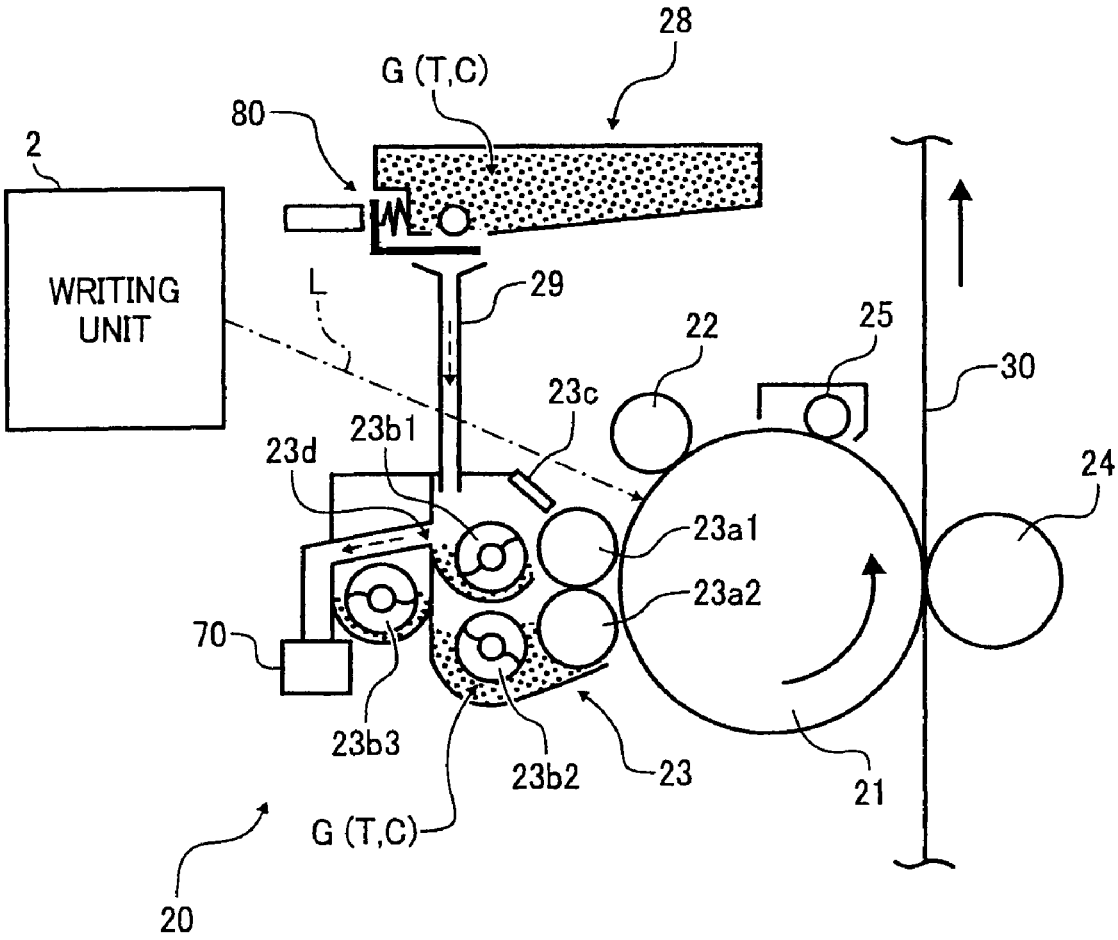
FIG. 2 is a diagram showing a process cartridge installed in this image forming apparatus.

FIG. 2 shows the process cartridge 20 and the developing agent cartridge 28 installed in the main body 1 of the apparatus.

As shown in FIG. 2, the process cartridge 20 includes the photosensitive drum 21 as image carrier, a charging unit 22, the developing device 23 (developing unit), and a cleaning unit 25, and adopts the premixed developing system (a developing method in which carrier is replenished and discharged as appropriate).

The photosensitive drum 21 as image carrier is a negatively charging organic photosensitive body that is driven to rotate in the counterclockwise direction by a rotational drive mechanism, which is not shown on the drawings.

The charging unit 22 is an elastic charging roller in which a urethane foam layer with intermediate electrical resistance is formed into a roller shape on a metal core. The urethane foam layer is made by processing urethane resin with carbon black as electrically conducting particles, vulcanizing agent, foaming agent, and so on. A rubber material such as urethane, ethylene propylene diene polyethylene (EPDM), butadiene acrylonitrile rubber (NBR), silicone rubber, isoprene rubber, or the like, in which an electrically conducting material, such as carbon black, metal oxides, or the like is dispersed to adjust the resistance, or these materials foamed, may be used as the material of the intermediate electrically conducting layer of the charging unit 22.

The cleaning unit 25 includes a cleaning brush (or a cleaning blade) in frictional contact with the photosensitive drum 21, which mechanically removes and recovers any untransferred toner on the photosensitive drum 21.

The developing device 23 includes two developing rollers 23*a*1, 23*a*2 as developing agent carriers, disposed close to the photosensitive drum 21. The part in opposition to the two developing rollers 23*a*1, 23*a*2 forms a developing area where the photosensitive drum 21 and a magnetic brush contact. The developing device 23 houses developing agent G (two part developing agent) that includes toner T and carrier C. The developing device 23 develops (forms toner images from) the electrostatic latent images formed on the photosensitive drum 21. The constitution and operation of the developing device 23 will be explained in detail later.

Here, the developing device 23 according to the present embodiment uses the premixed developing system. Therefore new carrier C (developing agent G) is supplied as appropriate to the developing device 23 from the developing agent cartridge 28. In addition, degraded developing agent G is discharged to a developing agent storage container 70 disposed to the outside of the developing device 23.

Referring to FIG. 2, the developing agent cartridge 28 houses developing agent G (toner T and carrier C) to be supplied to within the developing device 23. Also, the developing agent cartridge 28 can function as a toner cartridge for supplying new toner T to the developing device 23, or as supply means for supplying new carrier C to the developing device 23. Specifically, based on information on the toner concentration (the proportion of toner within the developing agent G) measured by a magnetic sensor 26 (see FIG. 4) disposed within the developing device 23, a shutter mechanism 80 is opened and shut, so that developing agent is supplied as appropriate from the developing agent cartridge 28 as supply means to within the developing device 23.

In the present embodiment, the percentage of toner T relative to the carrier C (the toner concentration) in the developing agent G in the developing agent cartridge 28 is set comparatively high.

A supply pipe 29 as supply means is a pipe for feeding the developing agent G (toner T and carrier C) supplied from the developing agent cartridge 28 to the developing device 23. In other words, developing agent G discharged from the developing agent cartridge 28 is supplied to the developing device 23 via the supply pipe 29.

Next, the process of forming images on the photosensitive drum 21 is explained.

Referring to FIG. 2, as the photosensitive drum 21 rotates in the counterclockwise direction, first the surface of the photosensitive drum 21 is uniformly charged at the position of the charging unit 22. Then, the charged surface of the photosensitive drum 21 arrives at the position of illumination by the illuminating light L, where a light exposure process is carried out by the writing unit 2. In other words, by selectively decharging the photosensitive drum 21 by the illuminating light L in accordance with the image information, a potential difference with the unilluminated non-image parts is caused (voltage contrast), and an electrostatic latent image is formed. In this light exposure process, charge is generated when charge generating material in the photosensitive layer of the photosensitive drum 21 is exposed to light, and the positive holes formed cancel the electrical charge on the surface of the photosensitive drum 21.

Then, the surface of the photosensitive drum 21 on which the latent image was formed reaches a position in opposition to the developing device 23. The electrostatic latent image on the photosensitive drum 21 contacts magnetic brushes on the developing rollers 23*a*1, 23*a*2, and the negatively charged toner T in the magnetic brushes adheres to the photosensitive drum 21 so the toner image becomes visible.

In detail, the developing agent G scooped up by the magnetic force of the magnetic pole of the upper developing roller 23*a*1 is leveled to the ideal amount by a doctor blade 23*c*, and then transported to the developing area (the areas where the two developing rollers 23*a*1, 23*a*2 are in opposition to the photosensitive drum 21) in opposition to the photosensitive drum 21. In the developing areas, friction occurs between the upstanding carrier C and the photosensitive drum 21. At this time, the toner T mixed with the carrier C becomes negatively charged due to friction with the carrier C. In contrast, the carrier C is positively charged. A predetermined developing bias is applied to the developing rollers 23*a*1, 23*a*2 by a power source, which is not shown on the drawings. As a result, an electric field is formed between the developing rollers 23*a*1, 23*a*2 and the photosensitive drum 21. Therefore because of the electric field the negatively charged toner T selectively adheres to only the image parts on the photosensitive drum 21 to form a toner image.

Then, the surface of the photosensitive drum 21 on which the toner image has been formed arrives at a position in opposition to the transfer belt 30 and the transfer roller 24. Then the toner image on the photosensitive drum 21 is transferred to the transfer material P which is transported to the position in opposition to the photosensitive drum 21 at this timing. At this time, a predetermined voltage is applied to the transfer roller 24.

Then the transfer material P onto which the toner image was transferred passes through the fixing unit 66, and is discharged outside the apparatus by a discharge roller 69.

Then residual toner T (untransferred toner) on the photosensitive drum 21 that has not been transferred onto the transfer material P arrives at the area in opposition to the cleaning unit 25 still adhering to the photosensitive drum 21. The untransferred toner on the photosensitive drum 21 is removed by the cleaning unit 25 and recovered.

Then, the surface of the photosensitive drum 21 passes by a decharging unit, which is not shown on the drawings, and the series of image forming processes on the photosensitive drum 21 is completed.

The following is a detailed description of the constitution and operation of the developing device 23.

Figure 3:
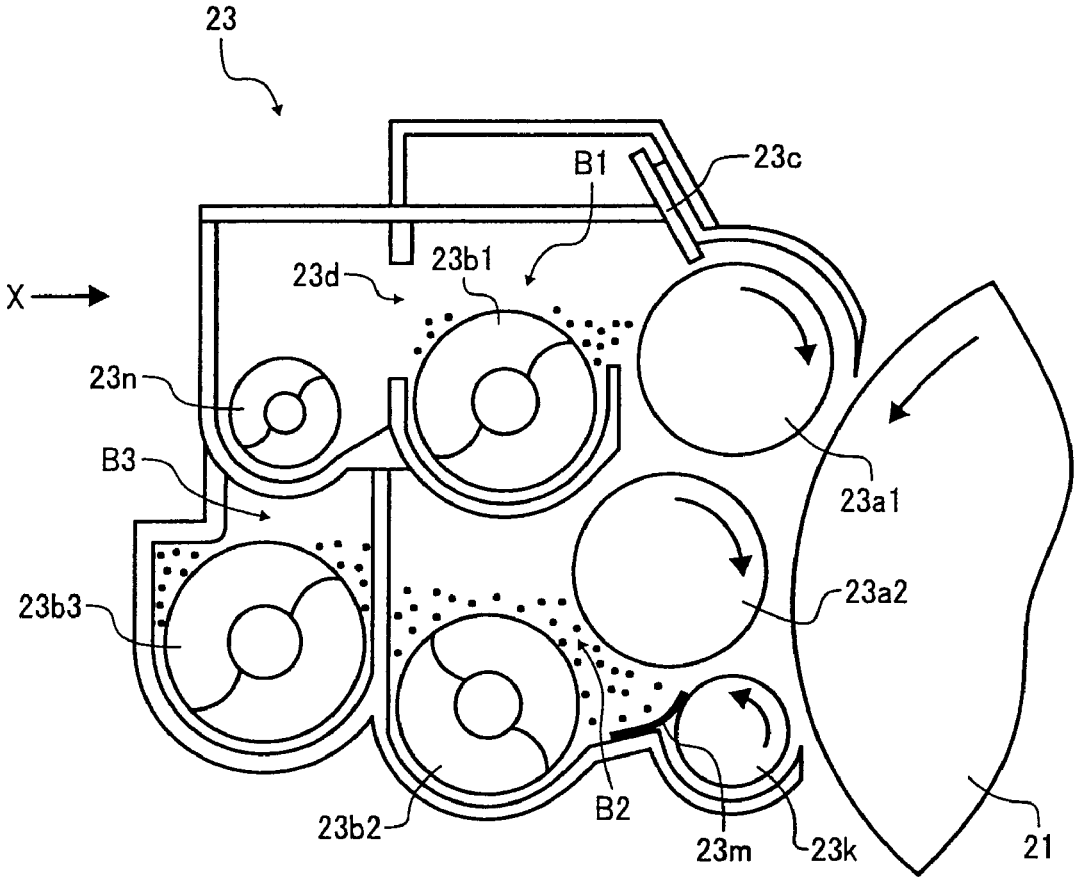
FIG. 3 is a diagram showing the image forming apparatus according to this embodiment.

Referring to FIG. 3, the developing device 23 includes the developing rollers 23*a*1, 23*a*2 as developing agent carrier, transport screws 23*b*1 to 23*b*3 (auger screws) as transport members, a doctor blade 23*c*, a carrier collection roller 23*k*, a scraper 23*m*, a discharge screw 23*n*, and so on. Also, three developing agent transport units B1 to B3 that form circulation paths along which developing agent G is transported are formed within the developing device 23.

The developing rollers 23*a*1, 23*a*2 are sleeves made from non-magnetic material such as aluminum, brass, stainless steel, electrically conducting resin, or the like, formed in the shape of a circular cylinder. The developing rollers 23*a*1, 23*a*2 are rotated in the counterclockwise direction by rotational drive mechanisms, which are not shown on the drawings. Magnets are fixed to the inside of the sleeves of the developing rollers 23*a*1, 23*a*2 that cause magnetic fields that make the developing agent G on the peripheral surface of the sleeve stand upright. The carrier C in the developing agent G stands up on the sleeve like a chain along the magnetic lines of force in the direction of the normal lines of the magnets. The charged toner T adheres to the carrier C that stands upright in this chain shape, to form a magnetic brush. The magnetic brush moves in the same direction (clockwise direction) as a result of the rotation of the sleeve.

The doctor blade 23*c* is disposed to the upstream side of the developing area, and controls the developing agent on the first developing roller 23*a*1 to be the ideal amount.

The three transport screws 23*b*1 to 23*b*3 are made from a spiral shaped screw portion formed on a shaft portion. The three transport screws 23*b*1 to 23*b*3 agitate and mix the developing agent G housed in the developing device 23 while circulating it in the length direction (the direction normal to the plane of the paper in FIG. 2).

The first transport screw 23*b*1 as the first transport member (one of the transport members) is disposed at a position in opposition to the developing roller 23*a*1 in the first developing agent transport unit B1. The first transport screw 23*b*1 transports the developing agent G in the horizontal direction (transport in the left direction indicated by the white arrow shown in FIG. 4), and in addition supplies developing agent G to the developing roller 23*a*1. In other words, the first developing agent transport unit B1 is in opposition to the developing roller 23*a*1, and supplies developing agent G to the developing roller 23*a*1 while transporting it in the length direction (the direction of the rotational axis of the developing roller 23*a*1).

The second transport screw 23*b*2 as second transport member is disposed in the second developing agent transport unit B2. The second transport screw 23*b*2 is disposed below the first transport screw 23*b*1 in a position in opposition to the developing roller 23*a*2. Then developing agent G that separates from the developing roller 23*a*2 (developing agent G forcefully removed from the developing roller 23*a*2 after the developing process by a developing agent removal pole) is transported in the horizontal direction (transport in the left direction indicated by the white arrow shown in FIG. 4). In other words, the second developing agent transport unit B2 is disposed below the first developing agent transport unit B1 in a position in opposition to the developing roller 23*a*2, and transports developing agent G that is separated from the developing roller 23*a*2 in the length direction.

The first transport screw 23*b*1 and the second transport screw 23*b*2 are disposed with their rotational axes virtually horizontal, as also are the developing rollers 23*a*1, 23*a*2, and the photosensitive drum 21.

The third transport screw 23*b*3 as third transport member is disposed in the third developing agent transport unit B3. The third transport screw 23*b*3 is disposed at an incline to the horizontal direction and connects the downstream side of the transport path of the second transport screw 23*b*2 and the upstream side of the first transport member 23*b*1 in a straight line (see FIG. 4). The third transport screw 23*b*3 transports developing agent G that has been transported by the second transport screw 23*b*2 to the upstream side of the transport path of the first transport member 23*b*1. In addition, the third developing agent transport unit B3 transports developing agent G that is circulated via a drop path 23*f* from the downstream side of the transport path of the first transport screw 23*b*1 to the upstream side of the transport path of the first transport screw 23*b*1 (the transport slanting upward to the right indicated by the white arrow in FIG. 4). In other words, the third transport screw 23*b*3 transports developing agent G transported by the second developing agent transport unit B2 to the upstream side of the first developing agent transport unit B1, and in addition transports developing agent G that has reached the downstream side of the first developing agent transport unit B1 to the upstream side of the first developing agent transport unit B1.

The transport path of the first transport screw 23*b*1 (the first developing agent transport unit B1), the transport path of the second transport screw 23*b*2 (the second developing agent transport unit B2), and the transport path of the third transport screw 23*b*3 (the third developing agent transport unit B3), are separated by wall members.

Figure 4:
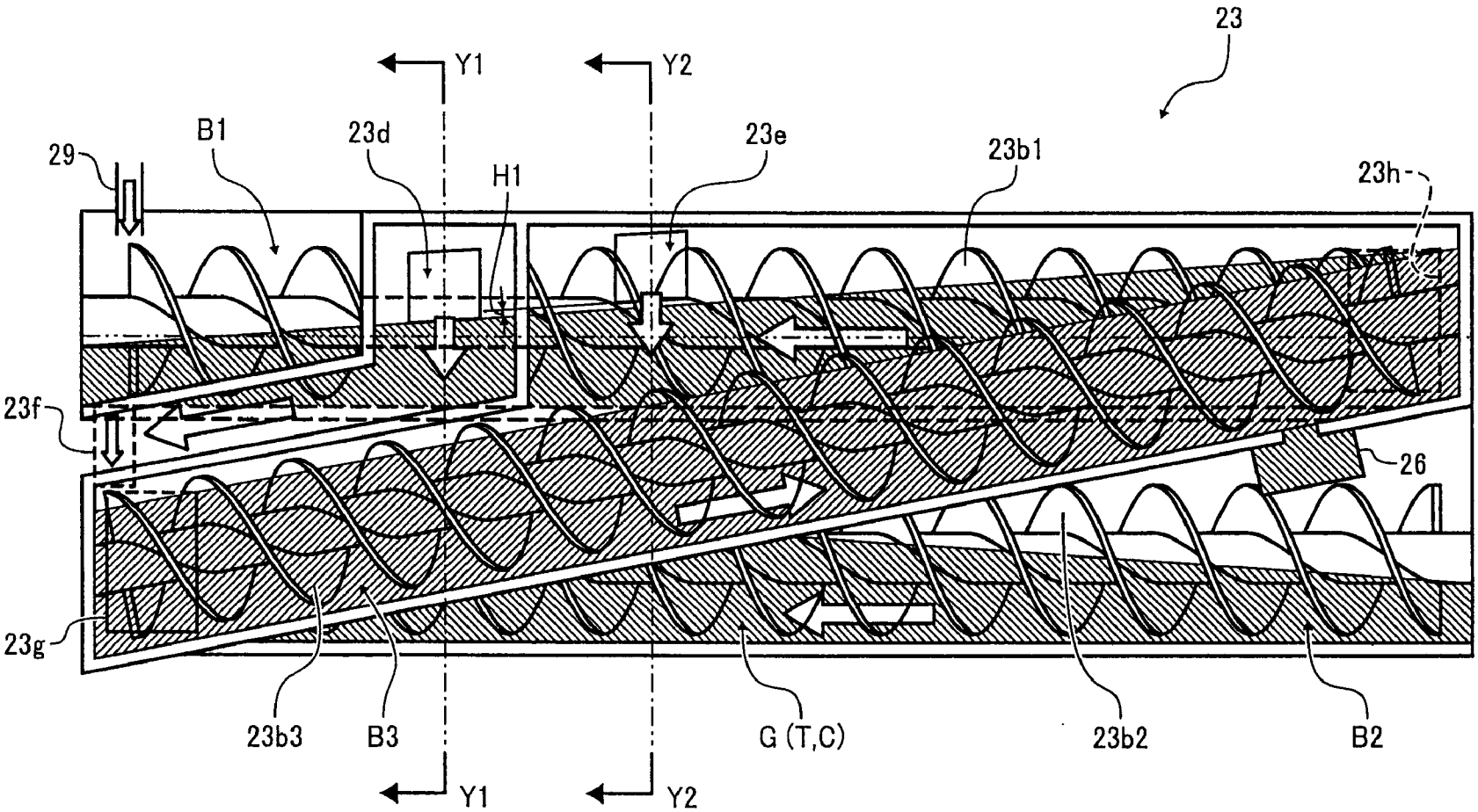
FIG. 4 is a cross-section view of the circulation path in this image forming apparatus, viewed in the long direction.

Referring to FIG. 4, the downstream side of the second developing agent transport unit B2 and the upstream side of the third developing agent transport unit B3 are linked by a first link portion 23*g*. Also, the downstream side of the third developing agent transport unit B3 and the upstream side of the first developing agent transport unit B1 are linked by a second link portion 23*h*. Also, the downstream side of the first developing agent transport unit B1 and the upstream side of the second developing agent transport unit B2 are linked by the drop path 23*f*.

As a result of this constitution, a circulation path that circulates the developing agent G in the length direction is formed in the developing device 23 by the three developing agent transport units B1 to B3 (transport screws 23*b*1 to 23*b*3). In this arrangement, when the developing device 23 is operating, the developing agent G housed within the device flows as indicated by the hatched lines in FIG. 4. Referring to FIG. 4, the reason that the surface level of the developing agent G at the downstream side of the first developing agent transport unit B1 is lower compared with the surface level on the upstream side is because during transport a part of the developing agent G is supplied to the developing roller 23*a*1. In other words, the developing agent G that is not supplied to the developing roller 23*a*1 is moved to the upstream side of the third developing agent transport unit B3 via the drop path 23*f*.

The magnetic sensor 26 as toner concentration sensor is disposed in the third developing agent transport unit B3. Based on the toner concentration information measured by the magnetic sensor 26, developing agent G with a predetermined toner concentration is supplied from the developing agent cartridge 28 as supply means to the developing device 23. In the present embodiment, the toner concentration of the developing agent G in the developing device 23 is controlled to be within the range 4 to 7 wt %.

Figure 5:
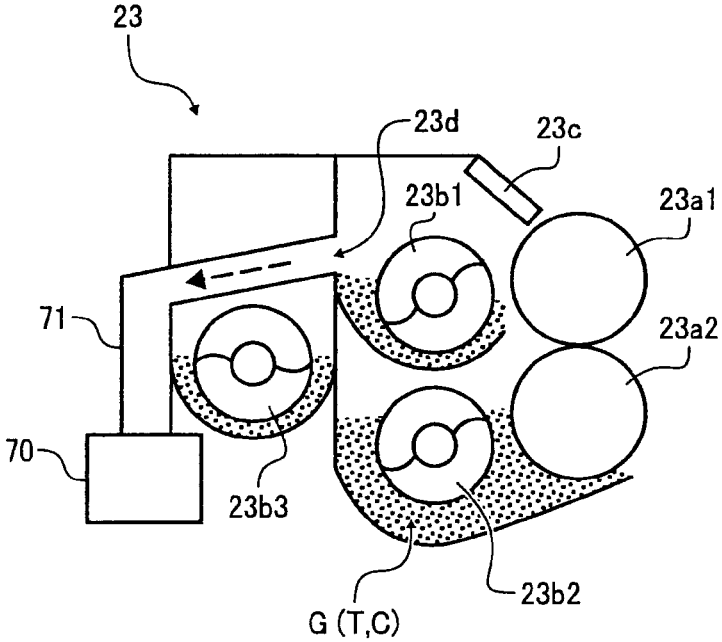
FIG. 5 is a cross-section view at the Section Y1-Y1 in the circulation path.

Referring to FIGS. 4 and 5, a discharge aperture 23*d* (discharge means) for discharging a part of the developing agent G housed within the developing device 23 to the outside (developing agent storage container 70) is provided in the wall of the first developing agent transport unit B1. In detail, the discharge aperture 23*d* is for discharging excess developing agent G to the developing agent storage container 70 when developing agent G is supplied to the developing device 23 by the supply means 28, 29, the quantity of developing agent within the device increases, and the surface of the developing agent (top surface) at the position of the discharge aperture 23*d* exceeds a predetermined level. In other words, the excess developing agent G exceeds the level of the bottom of the discharge aperture 23*d*, is discharged from the discharge aperture 23*d*, and drops under gravity to the developing agent storage container 70 via a discharge path 71. In this way, degraded carrier that is contaminated with the parent resin of the toner T or external additives is automatically discharged to the outside, so it is possible to reduce the degradation in image quality with time.

Although omitted from FIGS. 2 and 4, the discharge path 71 includes a discharge screw 23*n* (see FIGS. 3 and 8) for transporting developing agent discharged from the discharge aperture 23*d* in the horizontal direction.

Figure 6:
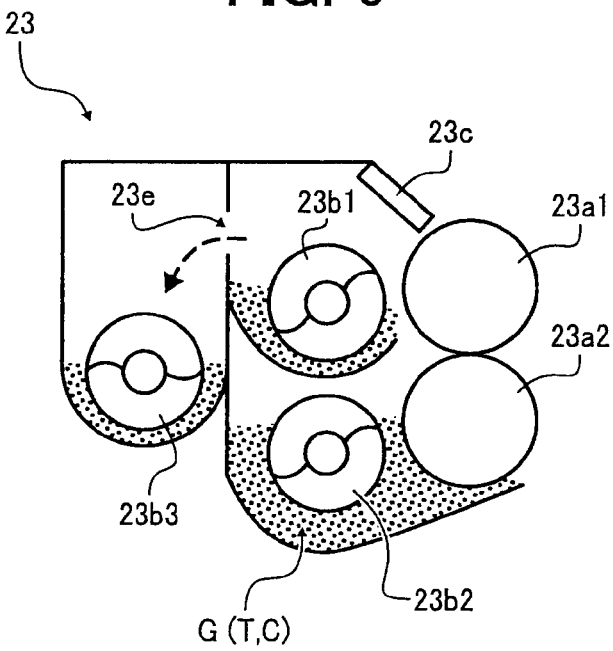
FIG. 6 is a cross-section view at the Section Y2-Y2 in the circulation path.

Also, a bias path is provided in the developing agent circulation path in the developing device 23 so that a part of the developing agent G does not pass the position at which the discharge aperture 23*d* is disposed, but is returned to the upstream side of the circulation path. Specifically, referring to FIGS. 4 and 6, an aperture 23*e* is provided on the upstream side of the discharge aperture 23*d* (in a position comparatively close to the discharge aperture 23*d*) in the first developing agent transport unit B1. Then the aperture 23*e* becomes the entrance to the bias path, and an exit to the bias path is provided in the transport path of the third transport screw 23*b*3 (near the middle in the length direction).

By providing the bias path in the developing agent circulation path of the developing device 23 in this way, even if wave-shaped undulations are produced in the developing agent within the developing device 23, it is possible to minimize the problem of variation being produced in the amount of developing agent discharged from the discharge aperture 23*d*, and more than the necessary amount of developing agent being discharged from the developing device 23.

Figure 7:
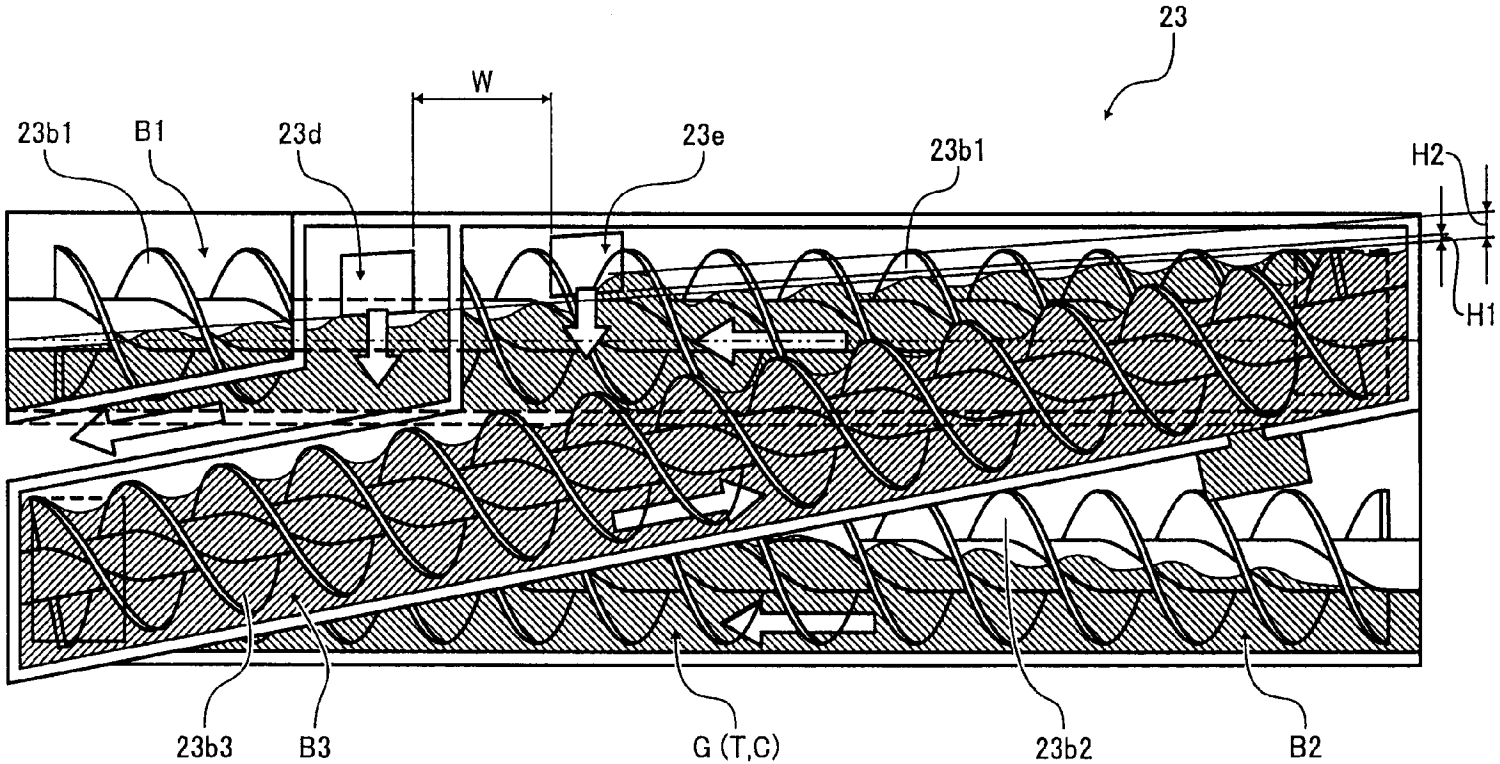
FIG. 7 is a diagram showing the state caused by wave-shaped undulations in the developing agent in the circulation path.

FIG. 7 is a diagram showing the state where wave-shaped undulations are produced in the developing agent in the developing agent circulation path in the developing device 23. Sometimes wave-shaped undulations with large differences between ridge and trough are produced in the developing agent circulation path in this way. This type of wave-shaped undulations appear prominently immediately after the start of operation (immediately after restarting) of the developing device 23. When this type of wave-shaped undulation is produced, conventionally all the developing agent in a position higher than the bottom of the discharge aperture 23*d* (the developing agent at the height H2 in FIG. 7) was discharged from the discharge aperture 23*d*. The developing agent discharged in this way was not originally intended to be discharged, so if this phenomenon occurs repeatedly the quantity of developing agent within the developing device 23 becomes insufficient. As a result the state of degradation of the developing agent becomes unstable, the amount of charge on the toner is reduced, and the problem that the image quality of the images output is reduced, and so on, is produced.

In contrast to this, in the present embodiment, the aperture 23*e* that connects with the bias path is provided on the upstream side of the discharge aperture 23*d*. Therefore, a part of the developing agent in a position higher than the bottom of the discharge aperture 23*d* is returned to the transport path of the third transport screw 23*b*3 through the aperture 23*e*, without being discharged from the discharge aperture 23*d*. In this way, it is possible to minimize the problem of developing agent being excessively discharged from the discharge aperture 23*d*.

Here, the level of the bottom of the aperture 23*e* in the bias path is higher than the level of the bottom of the discharge aperture 23*d* by just H1.

In this way, of the developing agent in a position higher than the bottom of the discharge aperture 23*d*, the part of the developing agent at the height (H2-H1) is returned to the transport path of the third transport screw 23*b*3 through the aperture 23*e*, without being discharged from the discharge aperture 23*d*. As a result it is possible to minimize the problem of excessive discharge of developing agent from the discharge aperture 23*d*, while maintaining the original function of the discharge means. Here, it is desirable to keep the distance W between the discharge aperture 23*d* and the aperture 23*e* in the length direction as short as possible.

In the present embodiment, the carrier collection roller 23*k* is disposed in a position in opposition to the photosensitive drum 21 and below the second developing roller 23*a*2 (on the downstream side in the direction of rotation), as shown in FIG. 3 (omitted in FIGS. 2 and 4, and others). Further, the scraper 23*m* is provided in a position in contact with the carrier collection roller 23*k*.

The carrier collection roller 23*k* is a circular cylindrical member made from stainless steel or the like, within which magnets that form a predetermined magnetic field are fixed. The carrier collection roller 23*k* collects carrier that moves (is suspended) within the developing device 23 and adheres to the photosensitive drum 21. The carrier collection roller 23*k* is driven to rotate in the counterclockwise direction in FIG. 3. Almost all the carrier collected by the carrier collection roller 23*k* is transferred to the second developing roller 23*a*2 at a position in opposition to the developing roller 23*a*2. The carrier is separated from the developing roller 23*a*2 at the position of the separation pole of the developing roller 23*a*2, and recovered into the second developing agent transport unit B2. On the other hand, the carrier that is not transferred to the developing roller 23*a*2 but that remains on the carrier collection roller 23*k* is mechanically scraped off by the scraper 23*m*, and recovered into the second developing agent transport unit B2. By providing the carrier collection roller 23*k* in this way, the carrier adhering to the photosensitive drum 21 can be recovered within the developing device 23. Therefore, it is possible to minimize the occurrence of faulty images (void images, images of the void), as well as minimize the problem of insufficient carrier within the developing device 23.

In the present embodiment, the external diameter of the developing rollers 23*a*1, 23*a*2 is 30 mm, the linear speed on the external peripheral surface of the developing rollers 23*a*1, 23*a*2 is 748 mm/second, the outer diameter of the carrier collection roller 23*k* is 16 mm, the linear speed on the outer peripheral surface of the carrier collection roller 23*k* is 10.6 mm/second, and the process line speed (linear speed on the outer peripheral surface of the photosensitive drum 21, and transport speed of the transfer material P) is set to about 440 mm/second.

Also, the carrier C used in the present embodiment has a particle diameter of 55 μm, and the saturation magnetization is about 96 emu/g. Further, the toner T used in the present embodiment has a particle diameter of around 6.8 μm.

In the following, the constitution and operation of a characteristic developing device 23 according to the present embodiment is described in detail in FIG. 8 and FIG. 9.

Figure 8:
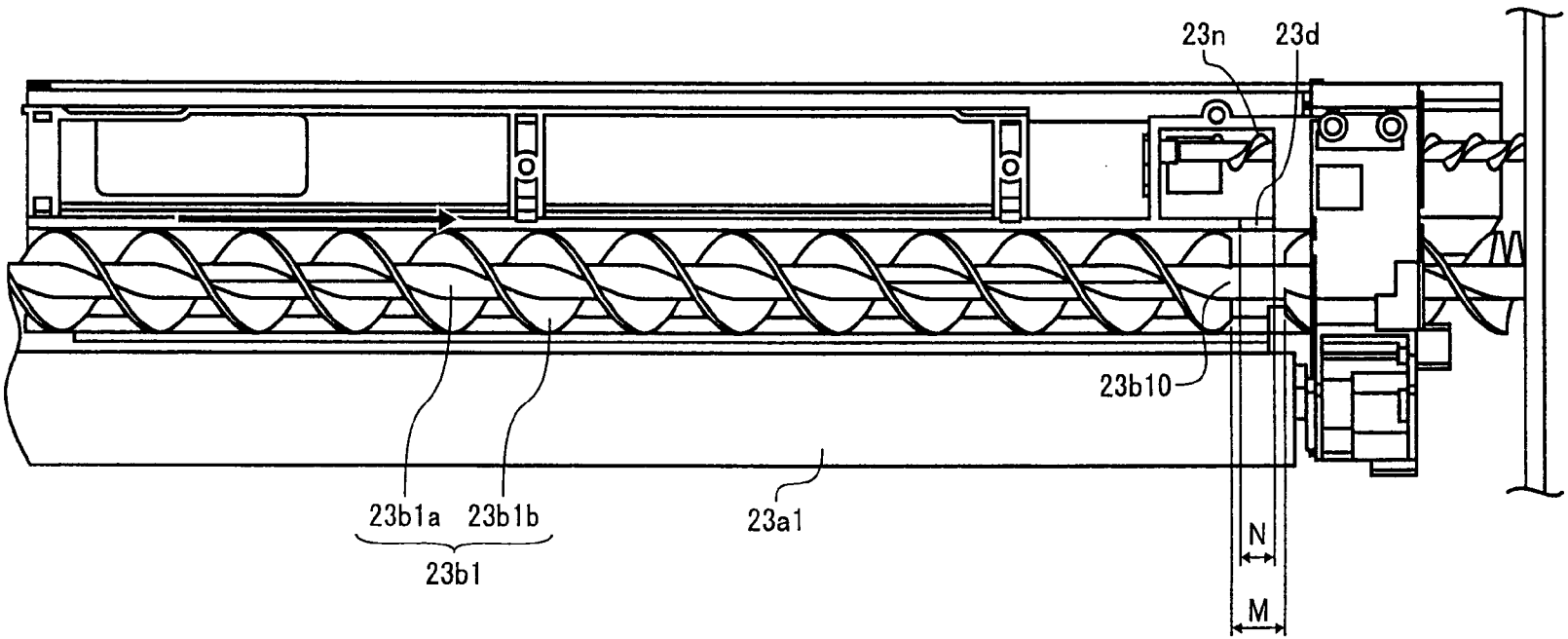
FIG. 8 is a top surface diagram showing the vicinity of a first transport member and the discharge aperture.
Figure 9:
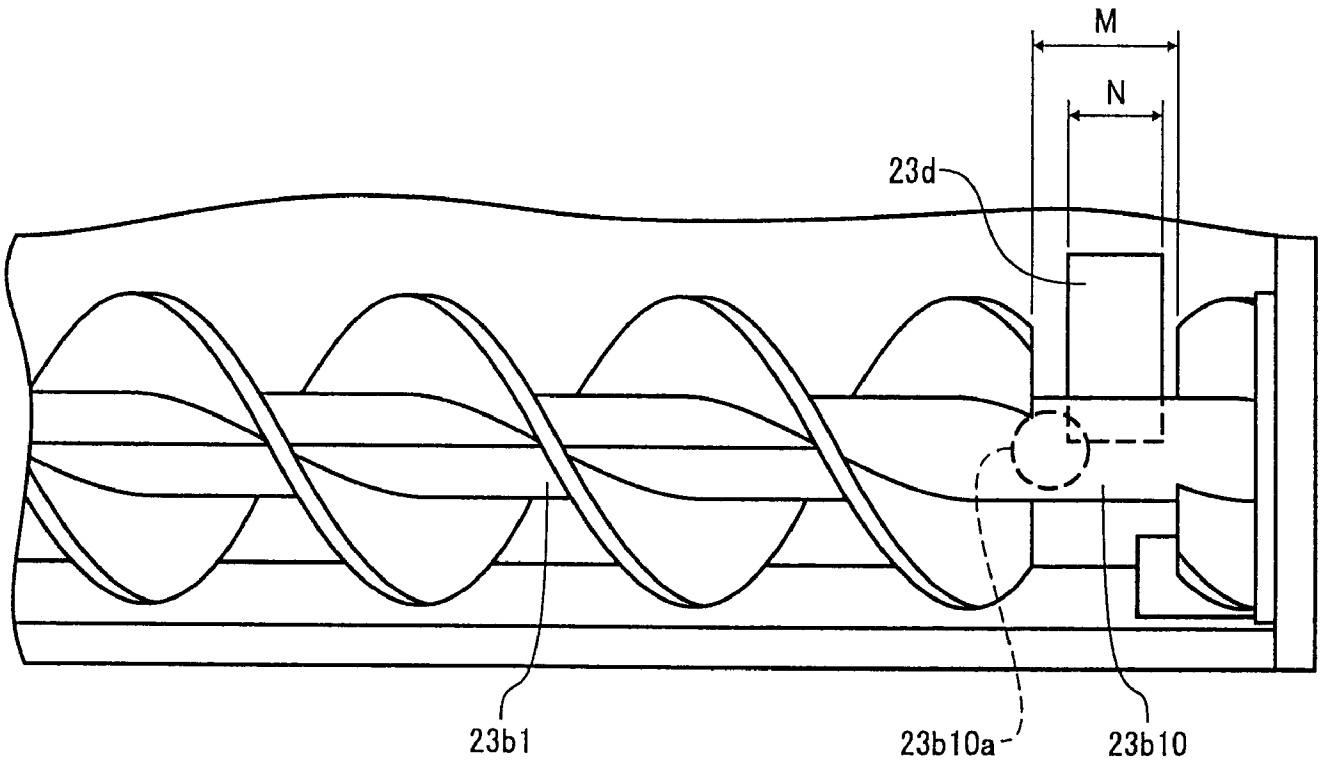
FIG. 9 is a side surface diagram showing the vicinity of the first transport member and the discharge aperture.

FIG. 8 shows the first transport screw 23*b*1 (first transport member) and the area around the discharge aperture 23*d*, and FIG. 9 shows the first transport screw 23*b*1 (first transport member) and the area around the discharge aperture 23*d*.

As shown in FIGS. 8 and 9, the first transport screw 23*b*1 includes a shaft portion 23*b*1*a* on which a spiral shaped screw portion 23*b*1*b* is formed. Also, an area 23*b*10 (the range M shown on the drawing, the area where the shaft portion 23*b*1*a* only is formed) where the screw portion 23*b*1*b* is not formed is provided on a part of the first transport screw 23*b*1 in the length direction. The area 23*b*10 where the screw portion 23*b*1*b* is not formed is provided in a non-image area (an area that does not contribute to image forming) in the downstream side of the first developing agent transport unit B1 (the transport path of the first transport screw 23*b*1).

Also, the discharge aperture 23*d* is disposed in opposition to the area 23*b*10 where the screw portion 23*b*1*b* is not formed on the first transport screw 23*b*1, and the length N in the length direction is formed smaller than the length M of the area 23*b*10 (M>N). The discharge aperture 23*d* is also provided in the downstream side of the first developing agent transport unit B1, in a non-image forming area.

By providing the area 23*b*10 where the screw portion 23*b*1*b* is not formed in this way, it is possible to reduce the amount of developing agent thrown up in the vicinity. Further, by making the length of the discharge aperture 23*d* in the length direction N smaller than the length of the area 23*b*10 in the length direction M, and positioning the discharge aperture 23*d* within the range in opposition to the area 23*b*10, it is possible to efficiently minimize the phenomenon of developing agent thrown up on the upstream side of the area 23*b*10 entering the discharge aperture 23*d* (movement of the developing agent as shown with an arrow in FIG. 10). As a result, only developing agent that should be discharged (the amount by which the surface of the developing agent is higher than the bottom of the discharge aperture 23*d*)) is discharged from the discharge aperture 23*d*. Therefore the problem of excessive discharge of developing agent and insufficient developing agent within the developing device 23 is minimized.

When the inventors of the present application carried out tests, it was found that according to the constitution described above, compared with the case where the length N of the discharge aperture 23*d* and the length M of the area 23*b*10 where the screw portion 23*b*1*b* is cut away are the same, the amount of developing agent thrown up by the first transport screw 23*b*1 and discharged from the discharge aperture 23*d* was significantly reduced. Further, by providing the area 23*b*10 where the screw portion 23*b*1*b* is not formed, it was found that, compared with the case where the area 23*b*10 is not provided, the slope of the developing agent (as explained earlier using FIG. 4, the phenomenon whereby the surface of the developing agent in the downstream side is lower than that in the upstream side) in the first developing agent transport unit B1 is smaller. Therefore it is more difficult for auger streak (unevenness in the image at the pitch of the screw portion 23*b*1*b* when the surface of the developing agent is low in the downstream side) to occur.

In the present embodiment, the discharge aperture 23*d* and the area 23*b*10 are provided in the downstream side of the first developing agent transport unit B1 in a non-image area. In this way, it is possible to eliminate the effect on the output image of the cut out in the screw portion 23*b*1*b* of the first transport screw 23*b*1.

As shown in FIGS. 8 and 9, preferably the discharge aperture 23*d* is not formed in opposition to the upstream side (towards the upstream side of the first developing agent transport unit B1, the area shown by the reference numeral 23*b*10*a* in FIG. 9) of the area 23*b*10 where the screw portion 23*b*1*b* is not formed. In other words, preferably the upstream edge of the discharge aperture 23*d* is provided at a position that is separated from the upstream edge of the area 23*b*10. In other words again, preferably the discharge aperture 23*d* is disposed within the range from the center to the downstream side of the area 23*b*10.

Figure 10:
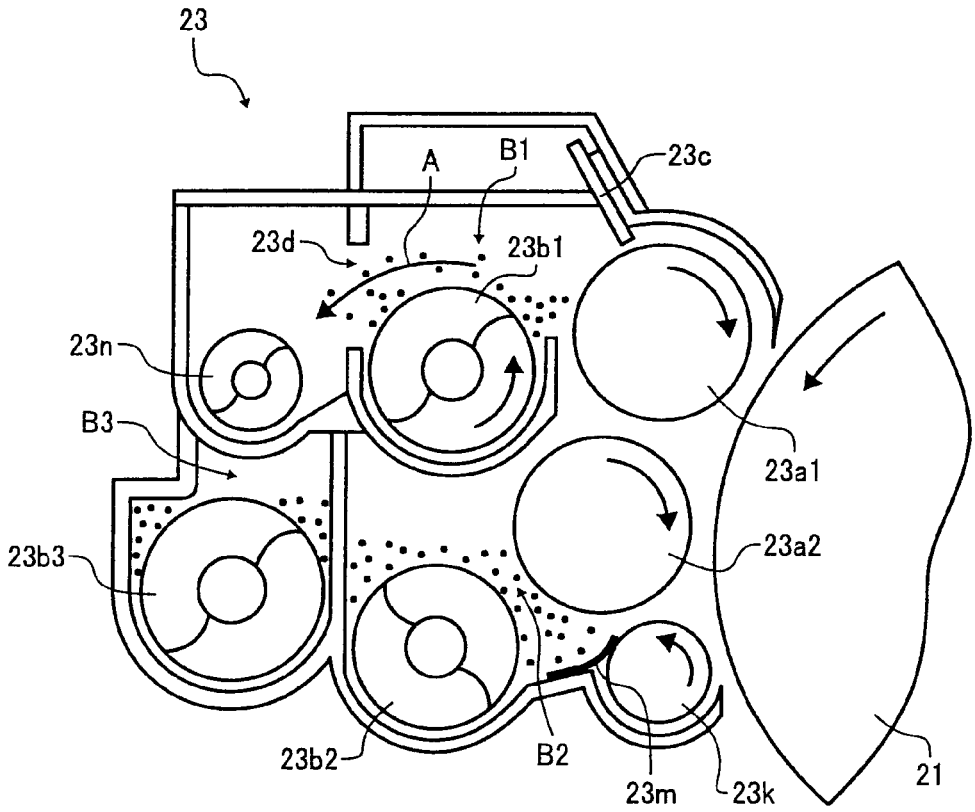
FIG. 10 is a diagram showing the state where the developing agent thrown up by the first transport member enters the discharge aperture.

By this constitution, the phenomenon of developing agent being thrown up by the rotation of the first transport screw 23*b*1 at the upstream side of the area 23*b*10 and entering the discharge aperture 23*d* (the movement of developing agent indicated by the arrow A in FIG. 10) is more positively reduced.

As explained above, in the present embodiment, the discharge aperture 23*d* is disposed in opposition to the area 23*b*10 where the screw portion 23*b*1*b* is removed from the first transport screw 23*b*1 (transport member). In addition, the length N of the discharge aperture 23*d* in the length direction is formed smaller than the length M in the length direction of the area 23*b*10 where the screw portion 23*b*1*b* is removed from the first transport screw 23*b*1. Therefore, developing agent thrown up by the first transport screw 23*b*1 is not discharged from the discharge aperture 23*d*. As a result variation in the amount of developing agent discharged to the outside is not caused, so it is possible to provide a premixed developing system developing device for which the image quality of the images output is stable.

In the present embodiment, the present invention was applied to a developing device 23 with three developing agent transport units B1 to B3. However, the present invention can also be applied to a developing device provided with two or four or more developing agent transport units. In these cases also, it is possible to obtain the same effect as in the present embodiment.

Also, in the present embodiment, the third transport screw 23*b*3 is disposed at a slant with respect to the horizontal direction, but the third transport screw 23*b*3 may be disposed horizontally.

Further, in the present embodiment, the discharge aperture 23*d* was provided in the wall of the first developing agent transport unit B1, but the discharge aperture 23*d* may also be provided in the wall of the other developing agent transport units B2, B3.

Also, in the present embodiment, developing agent G (toner T and carrier C) is supplied from the developing agent cartridge 28 as supply means to the developing device 23. However, carrier C only may be supplied from the supply means to the developing device 23. In this case, a cartridge housing toner only is provided separately from the developing agent cartridge (carrier cartridge), and toner housed in the toner cartridge is supplied as appropriate to the developing device 23 based on the measurement results of the magnetic sensor 26. In this case also, the same effect can be obtained as that of the present embodiment.

Also, in the present embodiment, the present invention was applied to an image forming apparatus in which a process cartridge 20 is constituted by a part of the image forming unit. However, the application of the present invention is not limited to this, and the present invention may be applied to an image forming apparatus in which the image forming unit does not constitute a process cartridge. Specifically, even where the developing device 23 alone is demountably installed in the main body of the image forming apparatus, the present invention can be applied.

Further, in the present embodiment, the present invention is applied to the case where two developing rollers 23*a*1, 23*a*2 are disposed within the developing device 23. However, the present invention can also be applied in the case that there is one or three or more developing rollers disposed within the developing device. In this case also, the same effect can be obtained as that of the present embodiment.

As explained above, in the present invention the discharge aperture is disposed in opposition to the area where the screw portion of the transport member is removed. In addition, the length in the length direction of the discharge aperture is formed smaller than that of the area where the screw portion of the transport member is removed. Therefore, developing agent thrown up by the transport member is not discharged from the discharge aperture. As a result variation in the quantity of developing agent discharged to the outside is not caused. Therefore it is possible to provide a premixed developing system developing device, process cartridge, and image forming apparatus for which the image quality of the images output is stable.

Various modifications will become possible for those skilled in the art after receiving the teachings of the present disclosure without departing from the scope thereof.

What is claimed is:

1. A developing device that houses a developing agent including carrier and toner, and that develops a latent image formed on an image carrier, comprising:

at least one developing roller;

a plurality of transport members which have a screw portion formed on a shaft portion, and which transport the developing agent housed within the device in a longitudinal direction, and form a circulation path; and a discharge aperture, formed in a wall of a transport path of one of the transport members, that discharges the developing agent outside the circulation path when a level of the developing agent transported by the one of the transport members exceeds a predetermined height, wherein the one of the transport members is disposed adjacent to the developing roller that supplies the developing agent and includes, in a part in the longitudinal direction, an area on which the screw portion is not formed, the discharge aperture is disposed opposite to the area on which the screw portion is not formed on the one of the transport members, and the length of the discharge aperture is formed smaller than that of the area in the longitudinal direction, and a length from an upstream end of the discharge aperture in the transportation direction of the developing agent to an upstream end of the area on which the screw portion is not formed, is greater than a length from a downstream end of the discharge aperture in the transportation direction of the developing agent to a downstream end of the area on which the screw portion is not formed.

2. The developing device according to claim 1, further comprising a supply member that supplies new carrier to the device.

3. The developing device according to claim 2, wherein the supply member supplies new toner together with the carrier to the device.

4. The developing device according to claim 1, wherein the discharge aperture is formed on a downstream side of the area on which the screw portion is not formed.

5. The developing device according to claim 1, wherein the discharge aperture is formed on a downstream side of the transport path of the one of the transport members.

6. The developing device according to claim 1, wherein the developing roller is disposed opposite to the image carrier and carries the developing agent, and wherein the plurality of transport members include:

a first transport member, disposed opposite to the developing agent carrier, that supplies the developing agent to the developing agent carrier;

a second transport member, disposed below the first transport member in a position opposite to the developing agent carrier, that transports the developing agent that has been separated from the developing agent carrier; and a third transport member that transports the developing agent transported by the second transport member to the upstream side of the transport path of the first transport member.

7. The developing device according to claim 1, wherein the one of the transport members includes a double-threaded screw.

8. The developing device according to claim 1, further comprising a bias path aperture, formed in the wall of the transport path of the one of the transport members and located upstream of the discharge aperture, the bias path aperture diverting developing agent to another one of the transport members.

9. The developing device according to claim 1, wherein a bottom of the discharge aperture is downwardly slanted toward a transportation direction of the developing agent within the one of the transport members.

10. A process cartridge which is detachably installed in a main body of an image forming apparatus, and in which a developing device and an image carrier are integrated, wherein the developing device houses a developing agent including carrier and toner, and develops a latent image formed on the image carrier, comprising:

at least one developing roller;

a plurality of transport members which have a screw portion formed on a shaft portion, and which transport the developing agent housed within the device in a longitudinal direction, and form a circulation path; and a discharge aperture, formed in a wall of a transport path of one of the transport members, that discharges the developing agent outside the circulation path when a level of the developing agent transported by the one of the transport members exceeds a predetermined height, wherein the one of the transport members is disposed adjacent to the developing roller that supplies the developing agent and includes, in one portion in the longitudinal direction, an area on which the screw portion is not formed, the discharge aperture is disposed opposite to the area on which the screw portion is not formed on the one of the transport members, and the length of the discharge aperture is formed smaller than that of the area in the longitudinal direction, and a length from an upstream end of the discharge aperture in the transportation direction of the developing agent to an upstream end of the area on which the screw portion is not formed, is greater than a length from a downstream end of the discharge aperture in the transportation direction of the developing agent to a downstream end of the area on which the screw portion is not formed.

11. The process cartridge according to claim 10, further comprising a supply member that supplies new carrier to the device.

12. The process cartridge according to claim 11, wherein the supply member supplies new toner together with the carrier to the device.

13. The process cartridge according to claim 10, further comprising a bias path aperture, formed in the wall of the transport path of the one of the transport members and located upstream of the discharge aperture, the bias path aperture diverting developing agent to another one of the transport members.

14. The process cartridge according to claim 10, wherein a bottom of the discharge aperture is downwardly slanted toward a transportation direction of the developing agent within the one of the transport members.

15. An image forming apparatus having a developing device and an image carrier, wherein the developing device houses a developing agent including carrier and toner, and develops a latent image formed on the image carrier, comprising:

at least one developing roller;

a plurality of transport members which have a screw portion formed on a shaft portion, and which transport the developing agent housed within the device in a longitudinal direction, and form a circulation path; and a discharge aperture, formed in a wall of a transport path of one of the transport members, that discharges the developing agent outside the circulation path when a level of the developing agent transported by the one of the transport members exceeds a predetermined height, wherein the one of the transport members is disposed adjacent to the developing roller that supplies the developing agent and includes, in one portion in the longitudinal direction, an area on which the screw portion is not formed, the discharge aperture is disposed opposite to the area on which the screw portion is not formed on the one of the transport members, and the length of the discharge aperture is formed smaller than that of the area in the longitudinal direction, and a length from an upstream end of the discharge aperture in the transportation direction of the developing agent to an upstream end of the area on which the screw portion is not formed, is greater than a length from a downstream end of the discharge aperture in the transportation direction of the developing agent to a downstream end of the area on which the screw portion is not formed.

16. The image forming apparatus according to claim 15, further comprising a supply member that supplies new carrier to the device.

17. The image forming apparatus according to claim 16, wherein the supply member supplies new toner together with the carrier to the device.

18. The image forming apparatus according to claim 15, further comprising a bias path aperture, formed in the wall of the transport path of the one of the transport members and located upstream of the discharge aperture, the bias path aperture diverting developing agent to another one of the transport members.

19. The image forming apparatus according to claim 11, wherein a bottom of the discharge aperture is downwardly slanted toward a transportation direction of the developing agent within the one of the transport members.

* * * * *